US006712056B2

(12) United States Patent
Omi

(10) Patent No.: US 6,712,056 B2
(45) Date of Patent: Mar. 30, 2004

(54) SLINGSHOT RELEASER

(75) Inventor: Shohei Omi, Anjo (JP)

(73) Assignee: Omi Kogyo Co., Ltd. (JP)

( * ) Notice: Subject to any disclaimer, the term of this patent is extended or adjusted under 35 U.S.C. 154(b) by 0 days.

(21) Appl. No.: 10/142,043

(22) Filed: May 9, 2002

(65) Prior Publication Data

US 2003/0037777 A1 Feb. 27, 2003

(30) Foreign Application Priority Data

Aug. 22, 2001 (JP) ..... 2001-251298

(51) Int. Cl.[7] ..... F41B 3/02; F41B 5/18
(52) U.S. Cl. ..... 124/20.1; 124/35.2
(58) Field of Search ..... 124/20.1, 35.2

(56) References Cited

U.S. PATENT DOCUMENTS 3,918,427 A 11/1975 Turner
4,873,963 A 10/1989 Lemmen
5,365,911 A 11/1994 Todd
5,370,102 A * 12/1994 Peck ..... 124/35.2
5,546,924 A * 8/1996 Todd ..... 124/35.2
5,566,664 A 10/1996 Todd
5,765,536 A * 6/1998 Scott ..... 124/35.2
5,996,565 A 12/1999 Whitmer
6,058,920 A * 5/2000 Tentler ..... 124/35.2

FOREIGN PATENT DOCUMENTS

FR 2 647 200 11/1990

* cited by examiner

*Primary Examiner*—John A. Ricci
(74) *Attorney, Agent, or Firm*—Akerman Senterfitt

(57) ABSTRACT

A slingshot releaser including a clamp, which stably holds a pouch attached to an elastic band and a pellet. The clamp has two rotatable holding rollers arranged on the distal ends of two arms. Each holding roller 17 has a peripheral surface including a support groove 21 and support rings 22, which are arranged perpendicular to the roller axis. The clamp has a pouch holder defined between the arms to hold the pouch when the clamp is closed. A lever is operated to open the clamp. This flings the pellet out of the clamp with the elastic force of the elastic band as the pouch and the pellet rotate the holding rollers.

10 Claims, 5 Drawing Sheets

SLINGSHOT RELEASER

BACKGROUND OF THE INVENTION

The present invention is related to a slingshot releaser for releasing an elastic band of a slingshot to fling a pellet.

In the prior art, to shoot a slingshot, a user holds a main body of the slingshot with one hand, draws a rubber band while holding a pellet pouch, which is attached to the rubber band, aims the pellet pouch toward a target, and then lets go of the rubber band to fling a pellet (ammo) toward the target.

To increase the initial velocity of the flung pellet, the distance between the main body of the slingshot and the pellet pouch (the drawn length of the rubber band) must be increased or a rubber band having a relatively large spring constant must be used. Thus, much strength is required to hold the pellet pouch. In addition to the strength required to draw the elastic band, strength is required in the fingers of the user. Thus, the conventional slingshot is difficult to aim.

SUMMARY OF THE INVENTION

It is an object of the present invention to provide a releaser of a slingshot that facilitates the holding of a pellet pouch.

To achieve the above object, the present invention provides a releaser used in a slingshot that includes an elastic band, which flings a pellet, and a pouch, which is attached to the elastic band. The releaser includes a clamp to holding the pouch. The clamp is selectively closed to hold the pouch and opened to release the pouch. Further, the clamp has a pouch holder to hold the pouch and the pellet. A pair of rotatable holding rollers is arranged on the clamp so that the holding rollers oppose each other, and the pair of holding rollers defines a holding passage connected to the pouch holder. The holding rollers are moved toward each other when the clamp is opened and separated from each other when the clamp is closed.

A further perspective of the present invention provides a releaser used in a slingshot that includes an elastic band, which flings a pellet, and a pouch, which is attached to the elastic band. The releaser includes a grip and a clamp, which is connected to the grip to hold the pouch. The clamp includes a pair of arms selectively arranged at a closed position, in which the arms close the clamp to hold the pouch, and at an opened position, in which the arms opens the clamp to release the pouch. The clamp has a pouch holder to hold the pouch and the pellet. The releaser further includes a pair of holding rollers, each arranged on a distal end of one of the arms and having an axis. The pair of holding rollers is arranged so that the axes of the holding rollers are parallel to each other. A drive mechanism shifts the pair of arms between the opened position and the closed position.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of a slingshot releaser 14 according to the present invention will now be discussed with reference to the drawings.

Hereafter, directions are defined as described below. As viewed from a shooter (user) who is standing, the direction toward the right is referred to as the X direction, the direction toward front is referred to as the Y direction, and the upward direction is referred to as the Z direction. A horizontal reference plane 412 lies along the X direction and the Y direction. A first vertical reference plane 523, which is perpendicular to the horizontal reference plane lies along the X direction and the Z direction. A second vertical reference plane 513, which is perpendicular to the horizontal reference plane 412 and the first vertical reference plane 513, lies along the Y direction and the Z direction.

Figure 1:
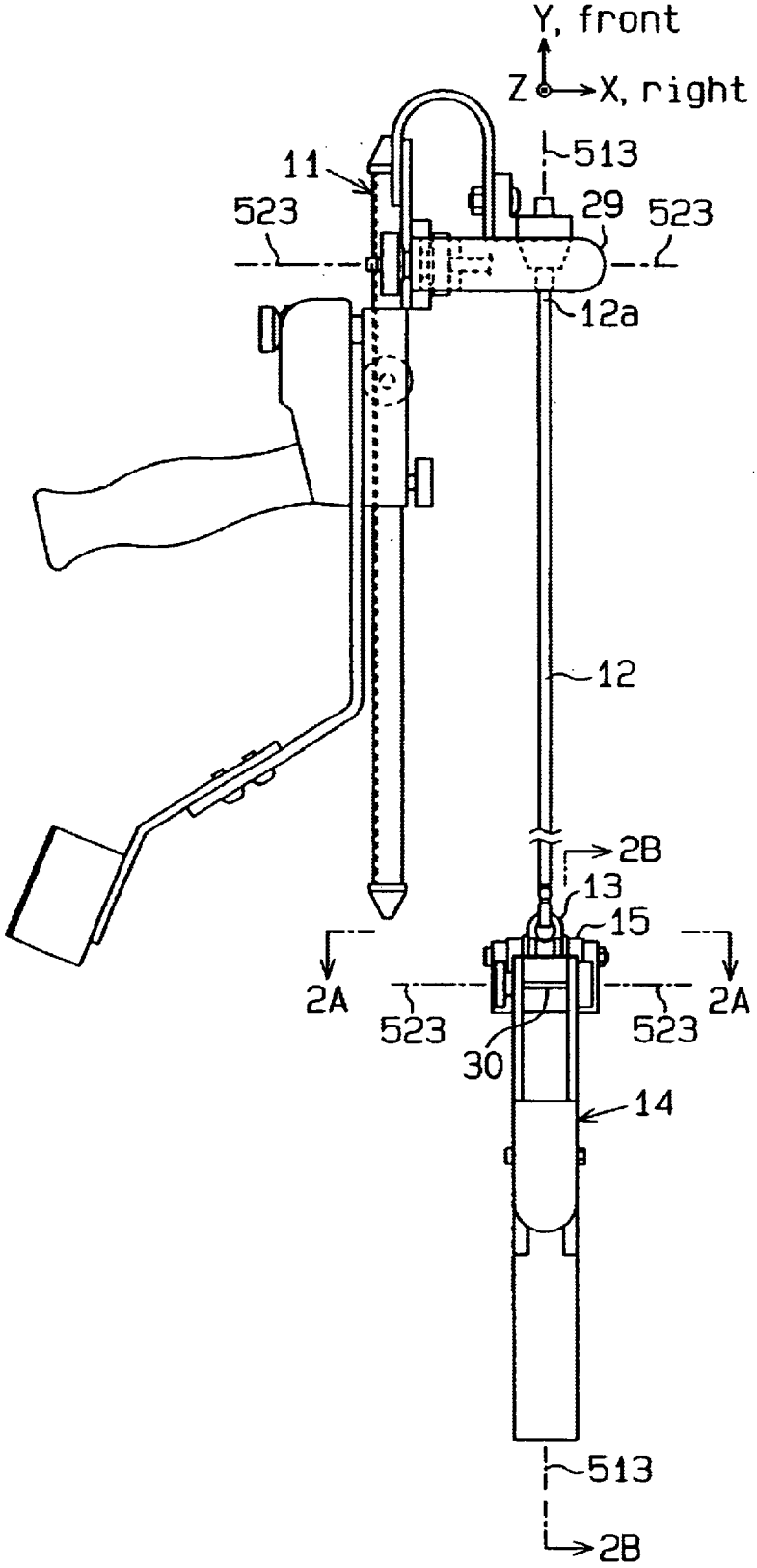
FIG. 1 is a plan view showing a releaser according to the present invention.

FIG. 1 shows the releaser 14 in a state of usage. The user holds a main body 11 of the slingshot with one hand and holds the releaser 14 with the other hand. A rubber band, or elastic band 12, has two ends 12*a* connected to the main body 11. A leather pellet pouch 13 is attached to the middle of the elastic band 12. In the state of FIG. 1, the pellet pouch 13 is held in the releaser 14.

Figure 2B:
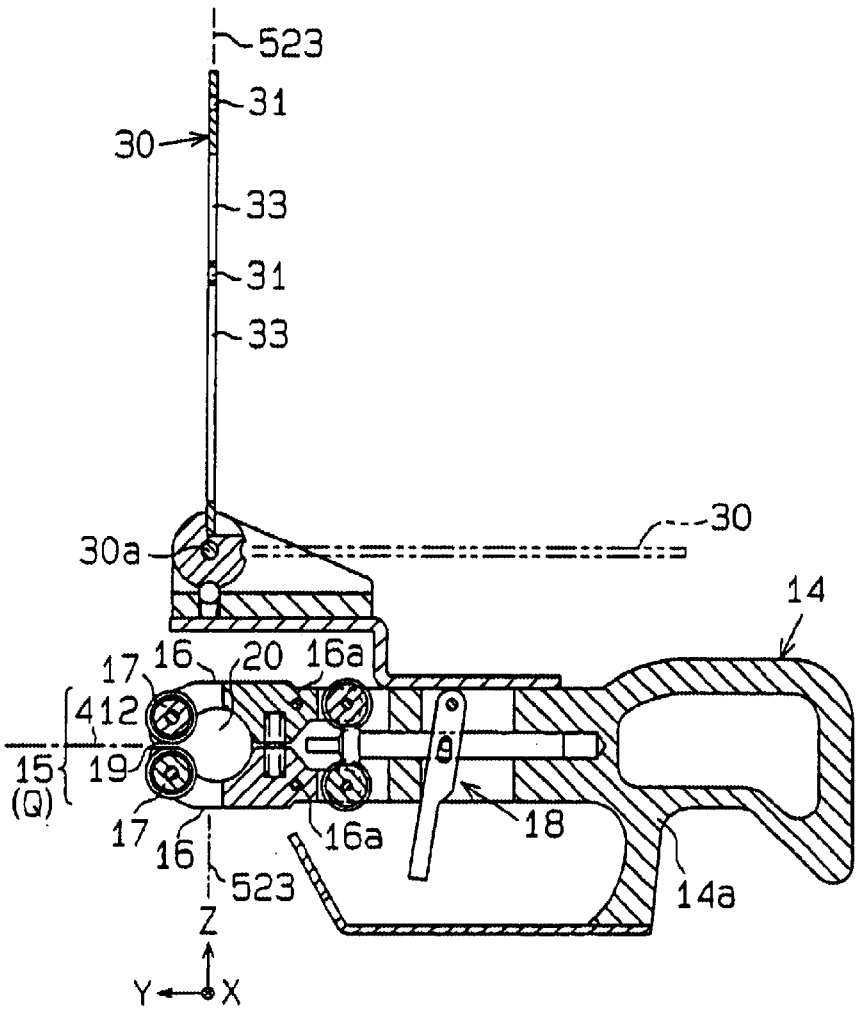
FIG. 2B is a cross-sectional view showing the releaser of FIG. 1.
Figure 2A:
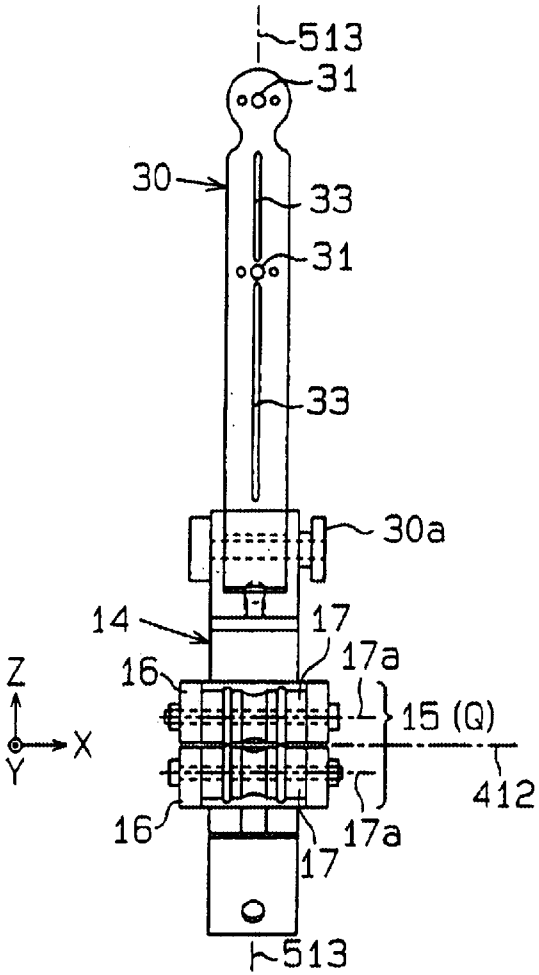
FIG. 2A is a front view showing the releaser of FIG. 1.

FIG. 2A is a front view of the releaser 14 as seen from line 2A—2A in FIG. 1. FIG. 2B is a cross-sectional view of the releaser 14 taken along line 2B—2B in FIG. 1. As shown in FIG. 2B, the releaser 14 includes a grip 14*a*, a clamp 15, which is connected to the grip 14*a*, and a drive mechanism 18, which opens and closes the clamp 15.

Figure 4A:
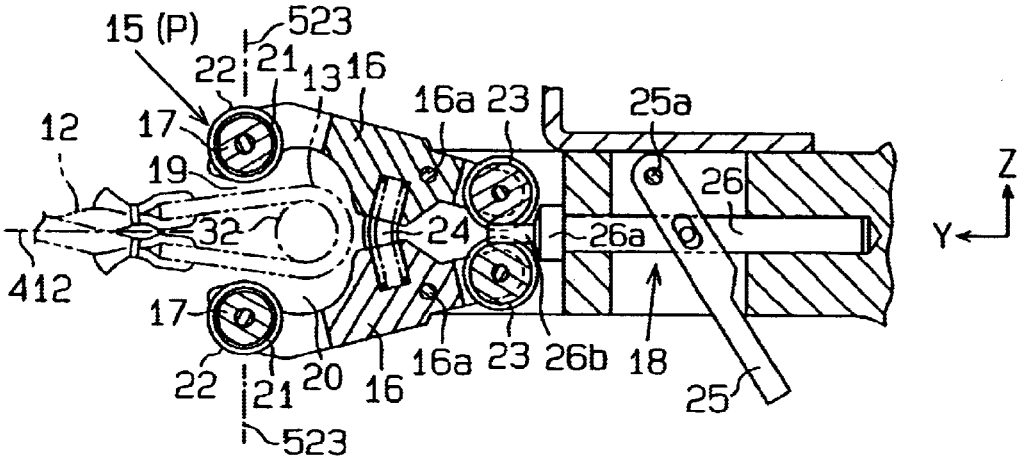
FIG. 4A is a cross-sectional view showing the clamp in an opened state.
Figure 4B:
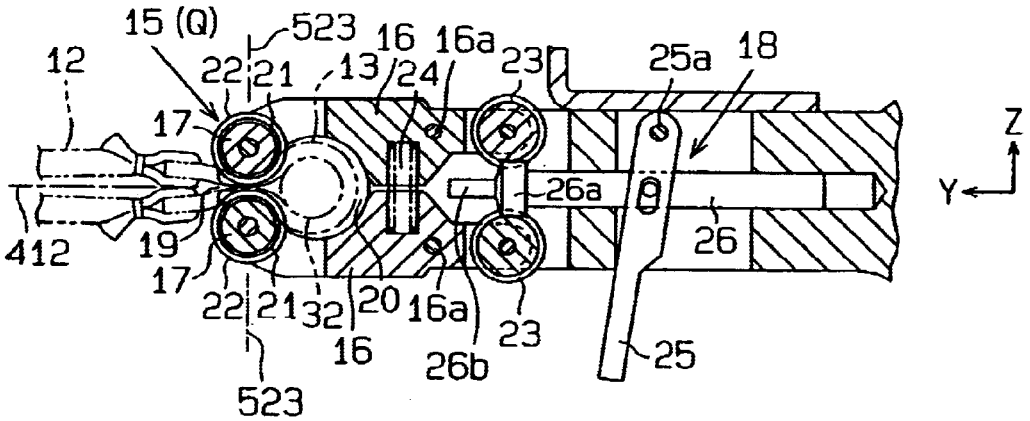
FIG. 4B is a cross-sectional view showing the clamp in a closed state.

The clamp 15 has two arms 16. Each arm 16 is supported pivotally about a pivot shaft 16*a*. A metal holding roller 17 is arranged on each arm 16. As shown in FIG. 2A, the axes 17*a* of the holding rollers 17 are parallel to each other. The user operates the drive mechanism 18 to open and close the two arms 16. FIG. 4A shows the clamp 15 in an opened state P, and FIG. 4B shows the clamp 15 in a closed state Q. The drive mechanism 18 will be described in detail later.

Figure 3A:
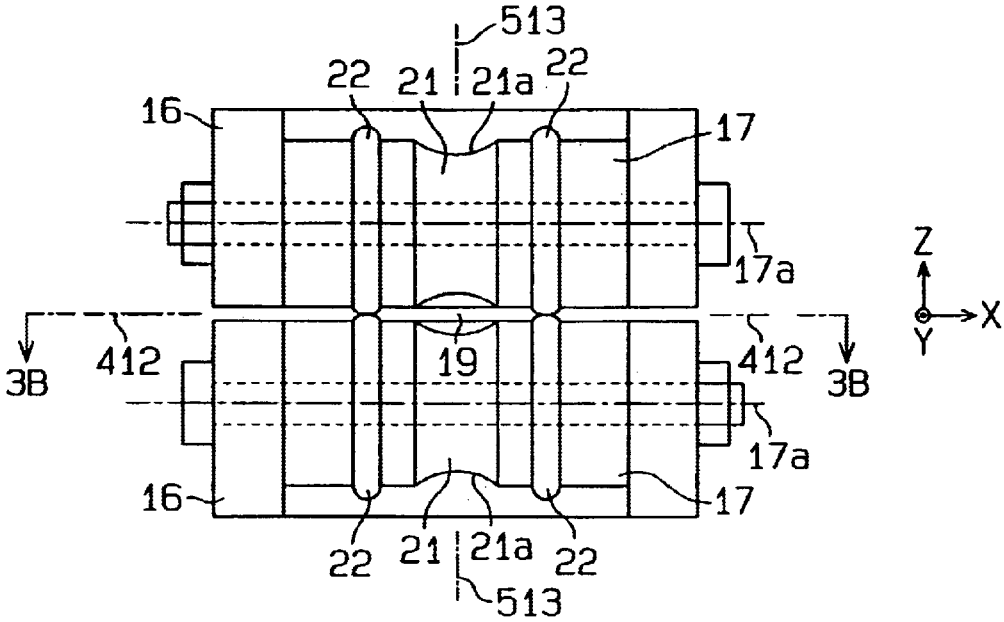
FIG. 3A is a partially enlarged view showing a clamp of the releaser of FIG. 2A.
Figure 3B:
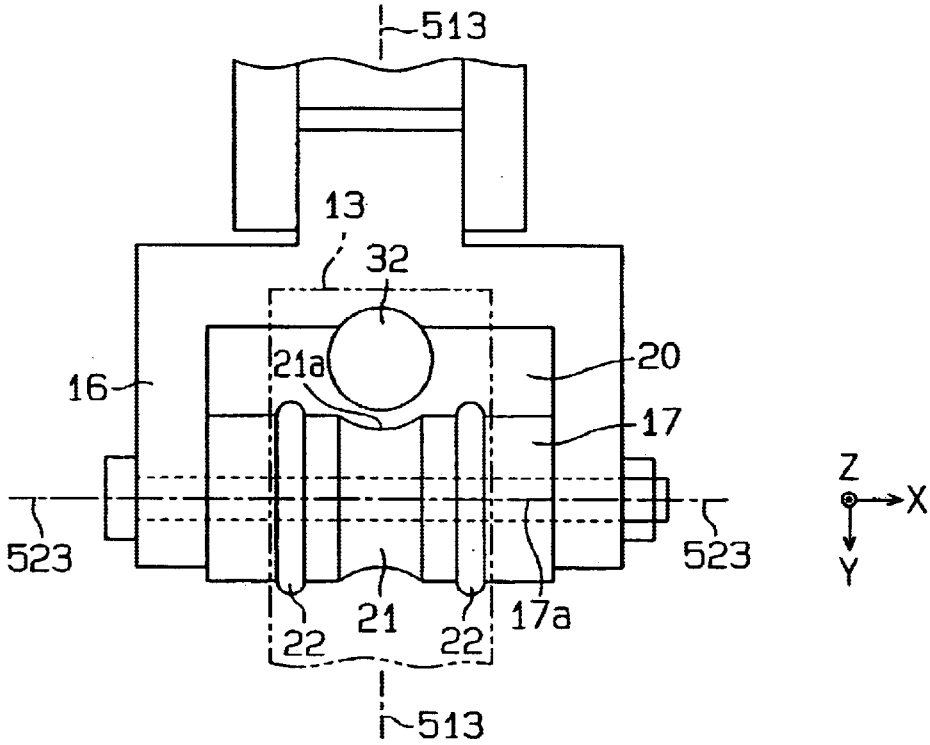
FIG. 3B is a plan view showing the clamp of FIG. 3A.

FIG. 3A is a front view showing the clamp 15 in a closed state. FIG. 3B is a plan view of the clamp 15 as seen from line 3B—3B in FIG. 3A.

Referring to FIG. 3A, a holding passage 19, which extends in the Y direction, is defined at the distal ends of the two arms 16. Further, a pouch holder 20 is defined between the two arms 16 (FIG. 2B). When the clamp 15 is in the opened state P, the two arms 16 are separated from each other and the holding passage 19 is expanded in the Z direction. When the clamp 15 is in the closed state Q, the two arms 16 are arranged close to each other and the holding passage 19 is contracted in the Z direction.

A support groove 21 extends along the peripheral surface in the circumferential direction at the middle of each holding roller 17. The two support grooves 21 of the two holding rollers 17 are aligned with each other and connect the holding passage 19 to the pouch holder 20. Each support groove 21 has an arcuate bottom surface, or support surface 21*a*. It is preferred that the support surface 21*a* be formed in correspondence with the round surface of a pellet (ammo) 32.

Each support groove 21 is located between two support rings 22, which are arranged on the peripheral surface of the associated holding roller 17. It is preferred that the support ring 22 be made of a flexible material such as rubber. When the clamp 15 is closed, the two support rings 22 of the upper holding roller 17 contact the two support rings 22 of the lower holding roller 17.

FIGS. 4A and 4B show the clamp drive mechanism 18. The clamp drive mechanism 18 includes a trigger, or lever 25, a slider 26, and a coil spring 24, which is held between the two arms 16. A cooperating roller 23 is connected to the basal end of each arm 16. The coil spring 24 is held between the arms 16 in a compressed state. The coil spring 24 biases the two arms 16 to open clamp 15 at the distal ends of the two arms 16, or move the two cooperating rollers 23 toward each other.

The lever 25 is supported pivotally about a pivot shaft 25*a*. The slider 26 cooperates with the lever 25 and moves between a front position, as shown in the state of FIG. 4B, and a rear position, as shown in the state of FIG. 4A. The slider 26 has an abutting portion 26*a*, a projection 26*b*, which projects toward the front, and a conical surface, which extends between the projection 26*b* and the abutting portion 26*a*. When the slider 26 is arranged at the rear position, the abutting portion 26*a* is moved out of the space between the two cooperating rollers 23. In this state, the coil spring 24 forces the cooperating rollers 23 toward each other and opens the clamp (opened state P). When the slider 26 is arranged at the front position, the abutting portion 26*a* enters the space between the two cooperating rollers 23 and separates the cooperating rollers 23 from each other. This closes and locks the clamp 15.

Figure 5A:
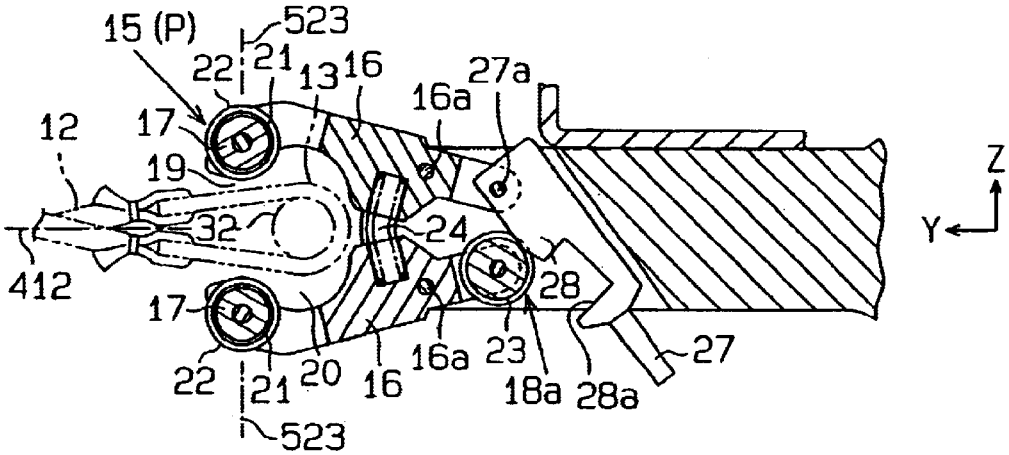
FIG. 5A is a cross-sectional view showing another clamp in an opened state.
Figure 5B:
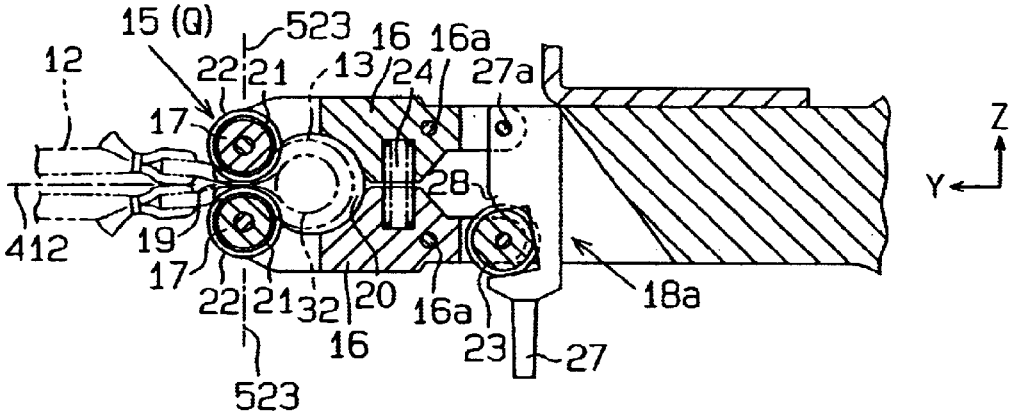
FIG. 5B is a cross-sectional view showing another clamp in a closed state.

FIGS. 5A and 5B show another example of the clamp drive mechanism 18 of FIGS. 4A and 4B. In the drive mechanism 18*a* of FIGS. 5A and 5B, a cooperating roller 23 is connected to the lower arm 16. A trigger, or lever 27, is connected to the upper arm 16 pivotally about a pivot shaft 27*a*. A coil spring 24, which is held between the two arms 16, biases the two arms 16 to open the clamp 15 so that the pivot shaft 27*a* and the cooperating roller 23 move toward each other. When the lever 27 is arranged at a rear position, as shown in the state of FIG. 5A, the cooperating roller 23 comes into contact with an abutting portion 28, which is defined on the lever 27. When the lever 27 is arranged at a front position, as shown in the state of FIG. 5B, the cooperating roller 23 is received in a notch 28*a*, which is formed in the lever 27. In other words, the abutting portion 28 enters the space between the pivot shaft 27*a* and the cooperating roller 23 to separate the pivot shaft 27*a* and the cooperating roller 23 from each other. The bordering area between the abutting portion 28 and the notch 28*a* is inclined. This facilitates the movement of the cooperating roller 23 between the abutting portion 28 and the notch 28*a*.

As shown in FIGS. 2A and 2B, the releaser 14 has a sight 30. The releaser sight 30 is attached to the upper part of the clamp 15. The sight 30 is pivotal 30*a* about a pin 30*a*. To use the sight 30, the sight 30 is lifted and arranged along the Z direction. When the sight 30 is not used, the sight 30 is folded as shown by the broken lines. The sight 30 includes two apertures, or sight holes 31, which are used for aiming, and two reference slits 33, which extend in the longitudinal direction of the sight 30. When the sight 30 is lifted, the reference slits 33 extend along a line connecting the sight holes 31 and the pouch holder 20. The sight holes 31 are separated by different distances from the clamp 15.

The method for using the releaser 14 will now be discussed.

The clamp 15 of the releaser 14 is first opened. The pellet 32 is enveloped in the pellet pouch 13. The pellet pouch 13 is then arranged in the pouch holder 20 and the clamp 15 is closed. This fixes the pellet 32 to the releaser 14. The user grips the main body 11 with his or her left hand so that a sight 29 of the main body 11 is faced upward and grips the grip 14*a* with his or her right hand. Then, the user draws the elastic band 12 and takes aim using the sight holes 31 of the releaser sight 30 and the main body sight 29 taking into consideration the height and distance of the target. The user also uses the reference slits 33 of the rear sight 30 when taking aim. When the user pulls the lever 25 or 27, the clamp 15 opens and releases the pellet pouch 13 from the releaser 14. As a result, the elastic force of the elastic band 12 flings the pellet 32 out of the pellet pouch 13. More specifically, the pellet pouch 13 is sent out of the pouch holder 20 through the holding passage 19. The two holding rollers 17 rotate as the pellet pouch 13 moves out of the pouch holder 20. Thus, the pellet 32 is flung out of the pellet pouch 13 as the pellet pouch 13 moves smoothly through the two holding rollers 17.

The preferred embodiment has the advantages described below.

The releaser 14 has the two rotatable holding rollers 17. Thus, the loading of the pellet pouch 13 and the flinging of the pellet 32 are performed smoothly. Further, each holding roller 17 is provided with the support groove 21 and the support rings 22 extending in the flinging direction of the pellet 32, and the holding rollers 17 rotate smoothly in the flinging direction. Thus, the pellet 32 is flung toward the target with high accuracy.

When the clamp 15 is in the closed state Q, the two holding rollers 17 support the pellet pouch 13 that envelops the pellet 32 between the support grooves 21. Thus, the releaser 14 holds the pellet pouch 13 in a stable manner.

The releaser 14 is provided with the pouch holder 20, which retains the pellet pouch 13 enveloping the pellet 32. Thus, the pellet pouch 13 is securely held.

The releaser 14 is provided with the support rings 22, which hold the pellet pouch 13. This stably positions the pellet pouch 13. The pellet pouch 13 is held further stably when the two support rings 22 are made of a flexible material such as rubber.

The projection 26*b* and the conical surface of the slider 26 facilitate the movement of the abutting portion 26*a* into the space between the two cooperating rollers 23. Accordingly, the drive mechanism 18 facilitates the opening and closing of the clamp 15.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A releaser used in a slingshot that includes an elastic band, which flings a pellet, and a pouch, which is attached to the elastic band, the releaser comprising:

a clamp for holding the pouch, wherein the clamp is selectively closed to hold the pouch and opened to release the pouch, and wherein the clamp has a pouch holder for holding the pouch and the pellet; and a pair of rotatable holding rollers arranged on the clamp, Opposed to each other, and defining a holding passage connected to the pouch holder, wherein the holding rollers are moved toward each other when the clamp is opened and separated from each other when the clamp is closed, wherein each of the holding rollers has a peripheral surface that includes a support groove extending circumferentially along the peripheral surface, the two grooves of the pair of holding rollers being opposed to each other and being connected with the holding passage and the pouch holder.

2. The releaser according to claim 1, wherein each support groove has an arcuate bottom surface.

3. The releaser according to claim 1, further comprising a pair of support rings arranged to extend circumferentially and continuously on each holding roller with the associated support groove located in between, wherein the pair of support rings of one of the holding rollers are opposed the pair of support rings of the other one of the holding rollers.

4. The releaser according to claim 1, wherein the clamp includes a pair of arms, each supporting one of the holding rollers, and the releaser further comprises a drive mechanism for driving the pair of arms and opening and closing the clamp.

5. A releaser used in a slingshot that includes an elastic band, and which flings a pellet, and a pouch, which is attached to the elastic band and the releaser comprising:

a grip;

a clamp connected to the grip for holding the pouch, wherein the clamp includes a pair of arms selectively arranged at a closed position, in which the arms close the clamp to hold the pouch, and an opened position, in which the arms opens the clamp to release the pouch, and wherein the clamp has a pouch holder for holding the pouch and the pellet; and a pair of holding rollers, each arranged on a distal end of one of the arms and having an axis, wherein the pair of holding rollers are arranged so that the axes of the holding rollers are parallel to each other, wherein each of the holding rollers includes a peripheral surface having a support groove extending perpendicular to the associated axis, wherein the support groove of one of the holding rollers is opposed to the support groove of the other one of the holding rollers; and a drive mechanism for shifting the pair of arms between the opened position and the closed position.

6. The releaser according to claim 5, wherein each of the holding rollers each includes a pair of support rings extending perpendicular to the associated axis, wherein the associated support groove is located between the support rings.

7. The releaser according to claim 6, wherein the pair of support rings of one of the holding rollers contacts the pair of support rings of the other one of the holding rollers when the clamp is closed.

8. The releaser according to claim 5, wherein the drive mechanism includes:

a lever operated to shift the pair of arms between the opened position and the closed position;

a coil spring for applying a biasing force to the pair of arms to open the clamp; and an abutting portion moved cooperatively with the lever, wherein the abutting portion is moved into a space between the pair of arms to dose the clamp against the biasing force of the coil spring.

9. A releaser used in a slingshot that includes an elastic band, which flings a pellet, and a pouch, which is attached to the elastic band, the releaser comprising:

a clamp for holding the pouch, wherein the clamp is selectively closed to hold the pouch an opened to release the pouch, and wherein the clamp has a pouch holder for holding the pouch and the pellet; and a pair of rotatable holding rollers arranged on the clamp, opposed to each other, and defining a holding passage connected to the pouch holder, wherein the holding rollers are moved toward each other when the clamp is opened and separated from each other when the clamp is closed, wherein a pair of support rings are arranged to extend circumferentially and continuously on each holding roller, and wherein the pair of support rings of one of the holding rollers are opposed the pair of support rings of the other one of the holding rollers.

10. A releaser used in a slingshot that includes an elastic band, which flings a pellet, and a pouch, which is attached to the elastic band, the releaser comprising:

a grip;

a clamp connected to the grip for holding the pouch, wherein the clamp includes a pair of arms selectively arranged at a closed position, in which the arms close the clamp to hold the pouch, and an opened position, in which the arms opens the clamp to release the pouch, and wherein the clamp has a pouch holder for holding the pouch and the pellet; and a pair of holding rollers, each arranged on a distal end of one of the arms and having an axis, wherein the pair of holding rollers are arranged so that the axes of the holding rollers are parallel to each other, wherein each of the holding rollers each includes a pair of support rings extending perpendicular to the associated axis; and a drive mechanism for shifting the pair of arms between the opened position and the closed position.

* * * * *